United States Patent [19]

Marx

[11] 4,365,764

[45] Dec. 28, 1982

[54] SUCTION APPARATUS FOR REMOVING FIBER MATERIAL

[75] Inventor: Hans-Jürgen Marx, Monchen-Gladbach, Fed. Rep. of Germany

[73] Assignee: Trützschler GmbH & Co. KG, Monchen-Gladbach, Fed. Rep. of Germany

[21] Appl. No.: 182,603

[22] Filed: Aug. 29, 1980

[30] Foreign Application Priority Data

Nov. 7, 1979 [DE] Fed. Rep. of Germany ..... 2944889

[51] Int. Cl.[3] ..... B65G 53/26; B65G 53/52

[52] U.S. Cl. ..... 241/101 A; 19/80 R; 104/161; 160/85; 160/122; 308/3.5; 406/115; 74/89.2; 277/DIG. 7

[58] Field of Search ..... 406/39, 52, 69, 70, 406/113-116; 241/101 A, 60, 277, 283; 19/80 R, 80 A, 81, 145.5; 104/173 R, 183, 194, 161; 92/88; 277/DIG. 7; 187/20; 74/89.2, 89.22; 160/85, 87, 122; 308/3.5

[56] References Cited

U.S. PATENT DOCUMENTS

| | | | |
|---|---|---|---|
| 1,679,912 | 8/1928 | Mondloch | 308/3.5 |
| 1,937,175 | 11/1933 | Tyler | 104/161 X |
| 4,234,075 | 11/1980 | Tingskog | 160/122 X |

OTHER PUBLICATIONS

Rieter Machine Works Limited Brochure; Automatic Bale Opening Machine 'Unifloc' Model A1.

*Primary Examiner*—Jeffrey V. Nase
*Attorney, Agent, or Firm*—Spencer & Kaye

[57] ABSTRACT

A fiber bale opener includes a truck arranged for back-and-forth displacement along a travelling path, an opening mechanism carried by the truck and arranged for removing fiber from the top of fiber bales positioned along the travelling path and a suction apparatus for carrying away, by an air stream, fiber removed from the bales by the opening mechanism. The suction apparatus includes a suction duct extending in the direction of the travelling path and a throughgoing slot on one side of the duct, extending parallel to the travelling path. The suction apparatus further has a flexible cover belt which extends over the slot for sealing the inside of the duct from the environment and which defines an interstice within the truck. The interstice travels with the truck and provides a passage for the fiber from the opening mechanism to the inside of the suction duct. The cover belt extends in two superposed layers from one side of the interstice to one end of the travelling path and from the other side of the interstice to the other end of the travelling path.

4 Claims, 2 Drawing Figures

SUCTION APPARATUS FOR REMOVING FIBER MATERIAL

BACKGROUND OF THE INVENTION

This invention relates to an apparatus for removing fiber-like material by suction, particularly in a bale opener. The apparatus has a stationary suction duct which, along its upper side, has a continuous longitudinal slot covered by a flexible cover belt, whereby the interior of the suction duct is sealed against outside air. The cover belt is fastened at both ends and is trained about deflecting rollers at the head ends of the suction duct. In one section, the cover belt leaves open a reciprocatingly movable interstice through which the fiber tufts are introduced into the suction duct.

In a known apparatus of the above-outlined type the suction duct is covered by a belt which is arranged in a single thickness (layer) above the longitudinal slot on either side of the interstice. The ends of the cover belt are secured to the machine frame in the region of the interstice. This arrangement has the drawback that the cover belt is continuously exposed to a vacuum and thus the interstice between the ends of the cover belt must be displaced by applying a substantial force to overcome the suction force with which the belt is pressed to the outside of the duct.

SUMMARY OF THE INVENTION

It is an object of the invention to provide an an apparatus of the above-outlined type from which the discussed drawbacks are eliminated so that the interstice founded by the belt can be moved by applying only slight displacing forces.

This object and others to become apparent as the specification progresses, are accomplished by the invention, according to which, briefly stated, the cover belt extends in two superposed layers from one side of the interstice to one end of the travelling path of the bale opener and from the other side of the interstice to the other end of the travelling path.

Thus, according to the invention, the lower one of the two layers remains stationary on the longitudinal slot while the upper layer is moved in a rolling motion. It is of significance in this arrangement that solely the lower, stationary part of the belt is exposed to the suction force. The machine thus displaces only the upper part of the cover belt which is not exposed to the suction force. Only very slight forces are require to effect such a displacement. A reversible pole drive motor of 1.0–1.3 kilowatt is sufficient to drive the machine, During operation, the machine has a traveling speed of 10 m/min or 30 m/min for idle return.

Preferably, the cover belt is made of a composite material. Such a material ensures a good seal, is flexible and tear resistant. Expediently, the cover belt has reinforcing ribs. Such reinforcing elements increase the tear resistance and prevent the cover belt from being excessively deformed by the suction force.

DESCRIPTION OF THE PREFERRED EMBODIMENT

Figure 1:
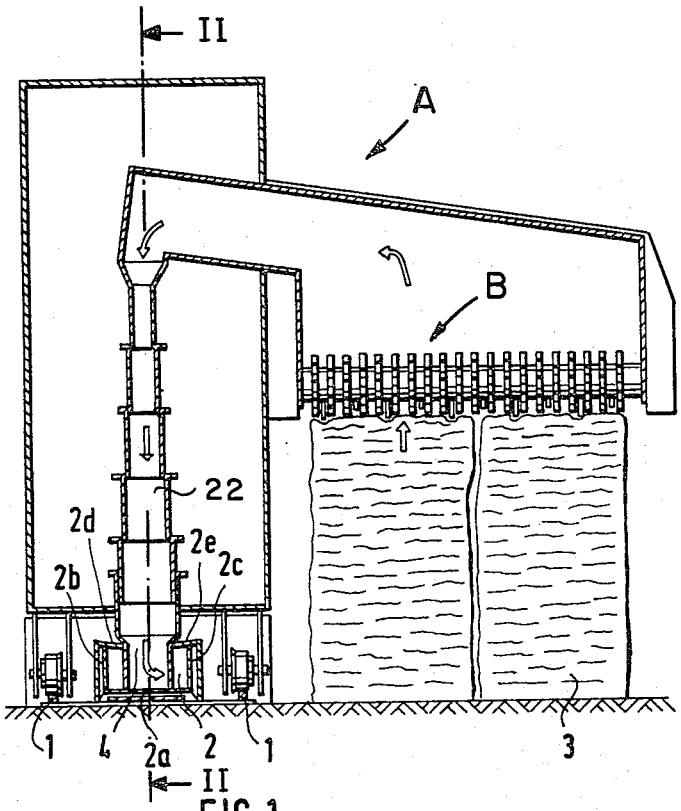
FIG. 1 is a sectional elevational view of a bale opener incorporating a preferred embodiment of the invention and taken along line I—I of FIG. 2.

Turning now to FIG. 1, there is shown a travelling bale opener A displaceable on rails 1 (in a direction perpendicular to the plane of FIG. 1) along a plurality of fiber bales 3 which are opened from the top by an opening mechanism B. A suction duct 2 through which the fiber tufts are removed by suction is disposed between the rails 1 above the floor. The suction duct 2 comprises a bottom panel 2*a*, two lateral walls 2*b* and 2*c* and a two-part top panel 2*d*, 2*e*. The two top parts 2*d* and 2*e* of the top panel are spaced from one another to define a continuous longitudinal slot 4 whose length extends perpendicularly to the plane of FIG. 1.

Figure 2:
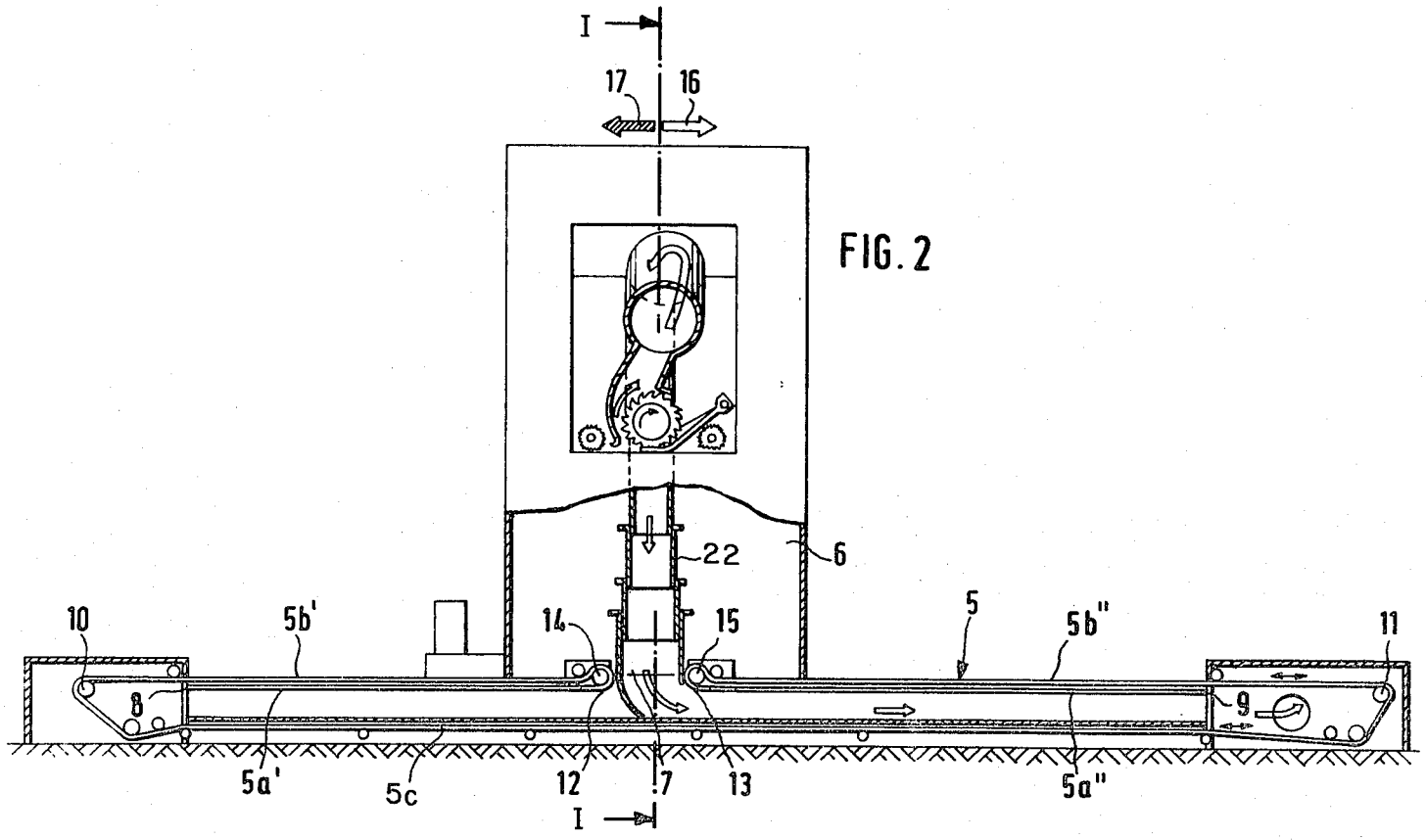
FIG. 2 is a sectional view taken along line II—II of FIG. 1.

Referring now to FIG. 2, the top side of the suction duct 2 is closed by a cover belt 5 which has such a course that it defines, within the travelling truck 6, an interstice 7 through which the tufts gain access to the suction duct 2 and which includes part of the longitudinal slot 4. The cover belt 5 is arranged in two layers thicknesses above the longitudinal slot 4 on either side of the interstice 7. The lower layers 5*a*′ and 5*a*″ on the two sides of the interstice 7 have their respective end 8, 9 stationarily fixed in the region of deflecting rollers 10,11, while their respective other end 12, 13 is trained around deflecting rollers 14, 15. The upper layers 5*b*′ and 5*b*″ extend from deflecting rollers 14, 15 to deflecting rollers 10, 11 and pass a single idle belt portion 5*c* underneath the suction duct 2. The arrow 16 designates the working direction, the arrow 17 designates the return run direction of the bale opener.

The cover belt 5 has the following course starting, for example, from end 8:

From the operationally stationary affixation point holding the end 8 of the cover belt 5 immobile, the cover belt extends, as lower cover belt layer 5*a*′, above the suction duct 2 over the slot 4 and is trained about the deflecting roller 14 to then extend, as upper cover belt layer 5*b*′, towards the deflecting roller 10. From there the cover belt 5 extends as idle portion 5*c* underneath the entire length of the suction duct 2 and is trained about the roller 11 to extend, as upper cover belt layer 5*b*″, to the deflecting roller 15. There the cover belt 5 is deflected to extend, as lower cover belt layer 5*a*″, to an affixation point at the end of the suction duct 2 adjacent the deflecting roller 11 and thus terminates in the immobilized cover belt end 9. Thus, as the truck 6 travels during operation back and forth in the direction of arrows 16 and 17, there will be communication between the inside of the suction duct 2 and the conduit 22 only through the interstice 7 while the other parts on either side of the interstice 7 are sealed by the lower cover belt layers 5*a*′ and 5*a*″ which do not move relative to the suction duct 2. The arrow 16 designates the working direction while the arrow 17 designates the direction of the idle return run.

It will be understood that the above description of the present invention is susceptible to various modifications, changes and adaptations, and the same are intended to be comprehended within the meaning and range of equivalents of the appended claims.

I claim:

1. In a fiber bale opener including a truck arranged for back-and-forth displacement along a travelling path, an opening mechanism carried by said truck and arranged for removing fiber from the top of fiber bales positioned along said travelling path and a suction apparatus for carrying away, by an air stream, fiber removed from the bales by the opening mechanism, said suction apparatus including a suction duct having a length extending in the direction of said travelling path and a throughgoing slot on one side thereof, extending parallel to said length, said suction apparatus further having a flexible cover belt extending over said slot for sealing the inside of said duct from the environment, said cover belt defining an interstice within said truck; said interstice travelling with said truck and providing a passage for the fiber from said opening mechanism to the inside of said suction duct; the improvement wherein said cover belt has first and second ends stationarily held at opposite ends of said travelling path; said suction apparatus having first, second, third and fourth belt deflecting means; said first and second belt deflecting means being carried by said truck and being situated from one another at a distance determining a length dimension of said interstice; said third and fourth belt deflecting means being supported at opposite ends of said travelling path adjacent the respective said first and second ends of said cover belt; said cover belt extending from said first end thereof to said first deflecting means and being trained thereabout; said cover belt extending from said first deflecting means to said third deflecting means and being trained thereabout; said cover belt extending from said third deflecting means to said fourth deflecting means and being trained thereabout; said cover belt extending from said fourth deflecting means to said second deflecting means and being trained thereabout; said cover belt extending from said second deflecting means to said second end; said cover belt extending in two superposed layers between said first end and said first deflecting means and between said second end and said second deflecting means.

2. A fiber bale opener as defined in claim 1, wherein at least one of said first, second, third and fourth belt deflecting means comprise deflecting rollers.

3. A fiber bale opener as defined in claim 1, wherein said cover belt is of a composite material.

4. A fiber bale opener as defined in claim 1, wherein said cover belt comprises reinforcing ribs.

* * * * *